US006337271B1

(12) United States Patent
Takahashi

(10) Patent No.: US 6,337,271 B1
(45) Date of Patent: Jan. 8, 2002

(54) POLISHING SIMULATION

(75) Inventor: Hiroshi Takahashi, Kanagawa (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 09/143,052

(22) Filed: Aug. 28, 1998

(30) Foreign Application Priority Data

Aug. 29, 1997 (JP) ..... PO9-233520

(51) Int. Cl.[7] ..... H01L 21/302

(52) U.S. Cl. ..... 438/650; 438/691; 438/692; 438/693; 438/697

(58) Field of Search ..... 438/690, 692, 438/693, 691, 745, 697

(56) References Cited

U.S. PATENT DOCUMENTS 5,337,015 A * 8/1994 Lustig et al. ..... 324/671
5,531,861 A * 7/1996 Yu et al. ..... 438/693
5,575,706 A * 11/1996 Tsai et al. ..... 438/693
5,584,146 A * 12/1996 Shamouillan et al. ..... 51/293
5,645,682 A * 7/1997 Skrovan ..... 438/692
5,685,766 A * 11/1997 Mattingly et al. ..... 451/36
5,692,950 A * 12/1997 Rutherford et al. ..... 451/552

* cited by examiner

*Primary Examiner*—Felisa Hiteshew
*Assistant Examiner*—Binh X. Tran
(74) *Attorney, Agent, or Firm*—Sonnenschein, Nath & Rosenthal

(57) ABSTRACT

The invention provides a polishing simulation in which calculation is proceeded while polishing rate parameter is successively updated as an offset shape of a substrate varies as polishing proceeds. When an uneven surface of a substrate is to be leveled by polishing, a deformation amount of a polishing cloth is determined on the assumption that a deformed shape of the polishing cloth by a convex of the substrate is a truncated cone, and a distribution of a polishing force is determined based on the deformation amount of the polishing cloth. Then, a distribution of a polishing amount of the substrate after a fixed interval of time is determined from the distribution of the polishing pressure, and a distribution of a height of the substrate is determined from the distribution of the polishing amount after the fixed interval of time. Finally, an expression for determination of an offset of the substrate is determined from the distribution of the height of the substrate.

2 Claims, 4 Drawing Sheets

POLISHING SIMULATION

BACKGROUND OF THE INVENTION

This invention relates to a polishing simulation, and more particularly to a polishing simulation applied for leveling of concave and convex portions formed on a semiconductor substrate.

Chemical mechanical polishing (CMP) which is an offset leveling technique for a surface of a substrate of a semiconductor device has been and is being employed popularly. However, an analysis of a mechanism of a leveling process has just been placed into argument. Particularly in leveling by chemical mechanical polishing, a pattern density dependency is observed so conspicuously that, if evaluation of a leveled shape of a pattern by working is not performed prior to the leveling, it cannot be determined whether or not the pattern can be accepted as a good pattern.

According to a method which has ordinarily been employed for such estimation, a distribution of stress deformation provided to a polishing cloth by an offset shape of a substrate is calculated in accordance with a finite element method, and a polishing rate for each point of the substrate is estimated based on the distribution. One of methods of the type described is disclosed, for example, in Y. Hayashide et al., VMIC Conference (USA), ISMIC-104/95/0464, 1995, and another method is disclosed in H. Ohtani et al., VMIC Conference (USA), ISMIC-104/95/0447, 1995.

However, since the offset shape varies as polishing proceeds, also the stress distribution varies similarly. Therefore, a polishing rate parameter must be varied. According to the method described above, since calculation of the stress distribution must be performed for each step, a very long time is required for the calculation. Accordingly, an analysis of a substrate which has such a complicated uneven (or concave and convex) shape as allows presence of various test element group (TEG) patterns thereon is very difficult.

SUMMARY OF THE INVENTION

It is an object of the present invention to provide a polishing simulation by which an analysis of a substrate having a complicated uneven shape can be performed in a reduced time.

In order to attain the object described above, according to the present invention, there is provided a polishing simulation applied for leveling of an uneven surface of a substrate by polishing, comprising the steps of determining a deformation amount of a polishing cloth on the assumption that a deformed shape of the polishing cloth by a convex portion of the substrate is a truncated cone, determining a distribution of a polishing force based on the deformation amount of the polishing cloth, determining a distribution of a polishing amount of the substrate after a fixed interval of time from the distribution of the polishing pressure, determining a distribution of a height of the substrate from the distribution of the polishing amount after the fixed interval of time, and determining an expression for determination of an offset of the substrate from the distribution of the height of the substrate.

In the polishing simulation, since the deformation amount of the polishing cloth is determined on the assumption that the deformed shape of the polishing cloth by a convex portion of the substrate is a truncated cone, also the deformation of the polishing cloth in the direction of the plane of the polishing cloth is taken into consideration, and consequently, the deformation condition of the polishing cloth is proximate to the deformation condition upon actual polishing. Consequently, the deformation amount of the polishing cloth can be determined almost accurately. Accordingly, the distribution of the polishing pressure which is determined based on the deformation amount of the polishing cloth and hence the distribution of the polishing amount after the fixed interval of time which is determined from the distribution of the polishing pressure can be determined almost accurately. Accordingly, by subtracting the polishing amount after the fixed interval time from the initial state, the distribution of the height of the substrate after the fixed interval of time can be determined almost accurately. Further, since an expression for determination of the offset of the substrate is determined, there is no necessity to calculate any transient solution, and consequently, the speed of calculation is raised and the time required for the calculation can be reduced significantly. As a result, the number of available data (number of grids) can be increased to raise the accuracy in calculation so that a highly accurate polishing simulation can be performed in a short time.

The above and other objects, features and advantages of the present invention will become apparent from the following description and the appended claims, taken in conjunction with the accompanying drawings in which like parts or elements denoted by like reference symbols.

DESCRIPTION OF A PREFERRED EMBODIMENT

Figure 1:
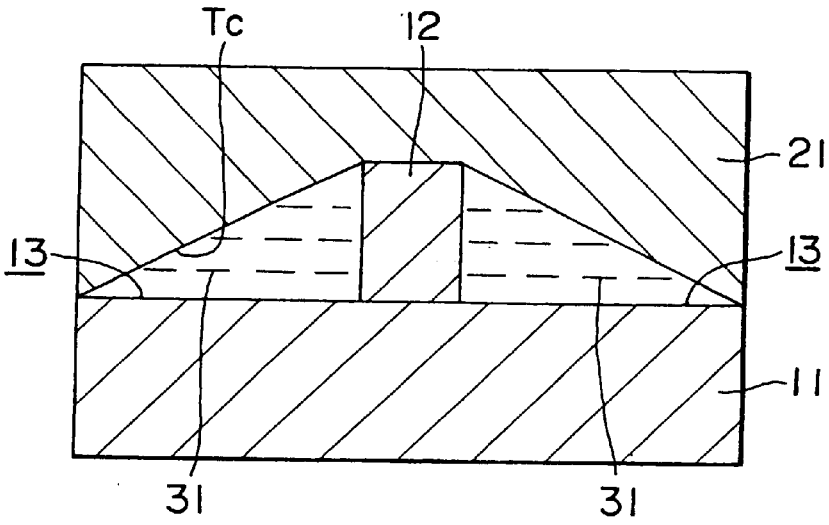
FIG. 1 is a schematic sectional view illustrating a characteristic of a polishing simulation according to the present invention.

First, a characteristic of a polishing simulation according to the present invention is described with reference to a schematic sectional view of FIG. 1. As seen from FIG. 1, it is assumed that, when an uneven or concave and convex surface of a substrate 11 is leveled by polishing, a polishing cloth 21 is deformed in such a manner as to exhibit such a shape as a truncated cone Tc by a convex portion 12 of the substrate 11. In particular, the deformation of the polishing cloth 21 occurs in a direction perpendicular to the plane of the polishing cloth 21 as well as in the direction of the plane of the polishing cloth 21. Here, it is assumed that, for example, polishing liquid 31 is filled between a concave portion 13 of the substrate 11 and the polishing cloth 21. In this manner, the polishing simulation according to the present invention is characterized in the assumption that the polishing cloth 21 is deformed to present a shape of a truncated cone Tc by the convex portion 12 of the substrate 11.

The polishing simulation according to a preferred embodiment of the present invention is described in detail below with reference to FIGS. 2 to 4.

Figure 2:
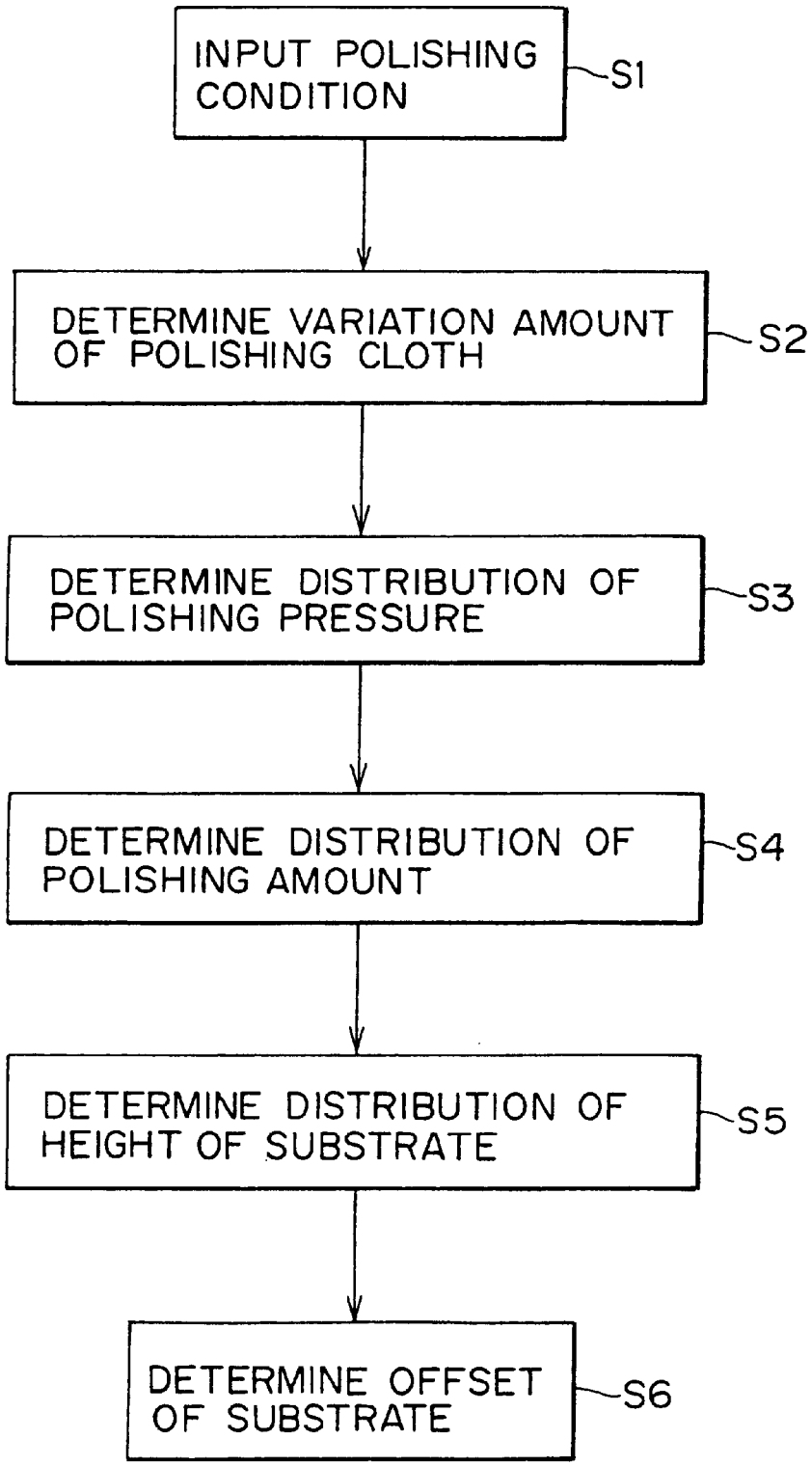
FIG. 2 is a flow chart illustrating different steps of the polishing simulation according to the present invention.

Referring first to FIG. 2, first in a "polishing condition inputting" step S1, various polishing conditions are inputted. In particular, the thickness of a film to be polished when the polishing time t is t=0, which is an initial state of polishing, is inputted as $X_0$, the offset on the substrate as $h_0$, the Young's module of the polishing cloth as E, the thickness of the polishing cloth as U, the height between the convex portion and the concave portion of the substrate 11 which is given as the height of the truncated cone described above as $X_1-X_2$, the unit area of the bottom face of the truncated cone as 1, and an averaged value of area rates of the top faces of truncated cones to the bottom faces of the truncated cones at points (i, j) over a fixed area S as $\alpha_{1i,j}$.

Figure 3:
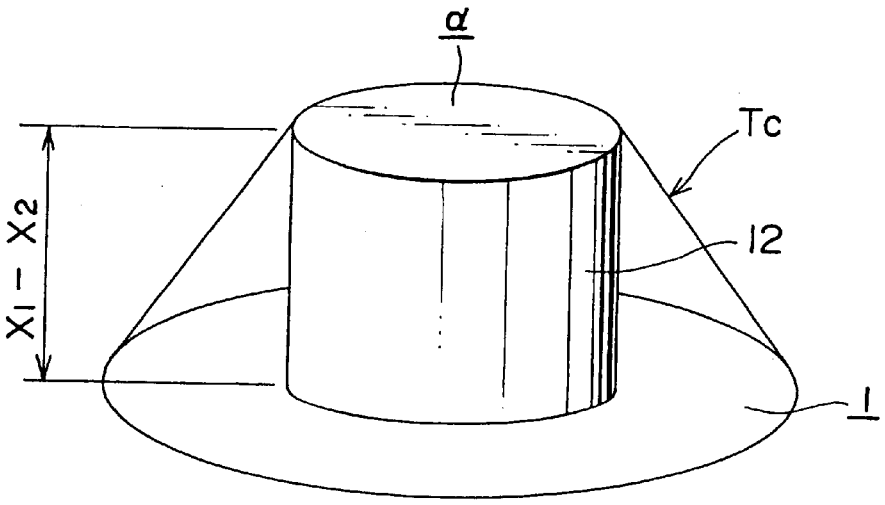
FIG. 3 is a schematic perspective view illustrating a deformation of a polishing cloth in the polishing simulation according to the present invention.

Then, in a "polishing cloth variation amount determination" step S2, the deformation amount of the polishing cloth is determined on the assumption that the polishing cloth is deformed to present a shape of the truncated cone Tc as seen in FIG. 3. Where the height of the convex portion 12 of the substrate 11 is represented by $X_1$ and the height of the concave portion 13 of the substrate 11 is represented by $X_2$, the height of the truncated cone Tc is given by $X_1-X_2$. Where the area of the bottom face of the truncated cone Tc when the polishing cloth is deformed to exhibit the truncated cone Tc is the unit area 1 and the area of the top face of the truncated cone Tc is represented by $\alpha$ with respect to the area of the bottom face, the volume of the truncated cone Tc, that, is, the deformation amount of the polishing cloth at each point (i, j) is given by $(\alpha_{1i,j}+\sqrt{\alpha_{1i,j}}+1)(X_1-X_2)/3$.

Figure 4A:
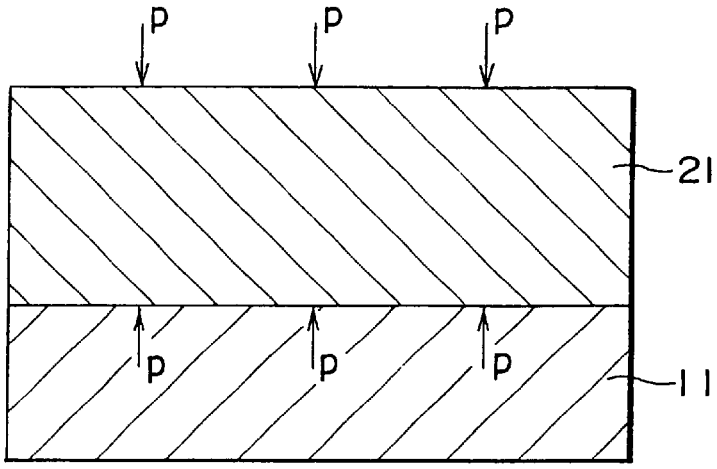
FIGS. 4A to 4C are schematic sectional views illustrating polishing pressures in the polishing simulation according to the present invention.
Figure 4B:
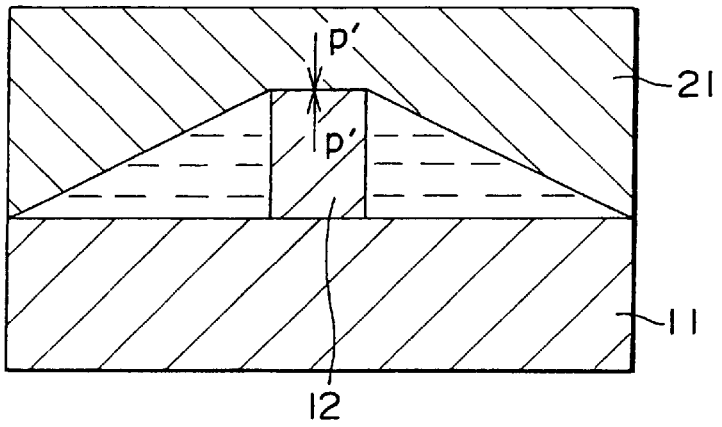
Figure 4C:
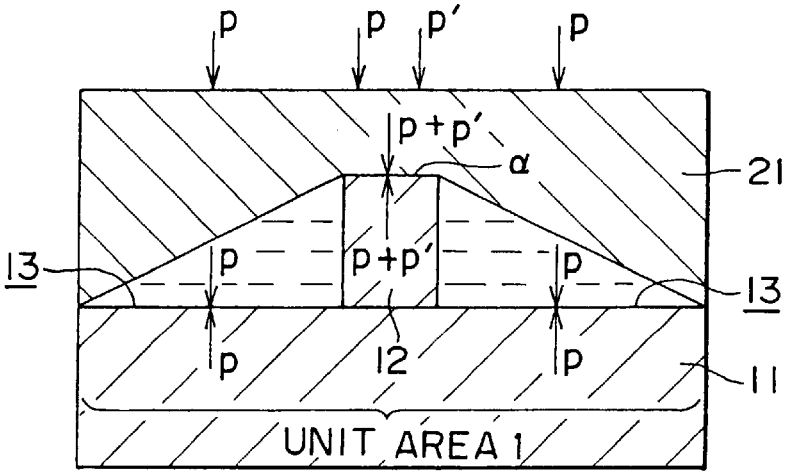

Then, in a "polishing pressure distribution determination" step S3, a distribution of the polishing pressure is determined based on such deformation amounts of the polishing cloth. Here, the pressure applied to the substrate 11 from the polishing cloth 21 where the substrate 11 is flat is represented by p as seen in FIG. 4A. Meanwhile, the pressure applied only to the convex portion 12 of the substrate 11 is represented by p' as seen in FIG. 4B. Accordingly, the pressure actually applied to the substrate 11 from the polishing cloth 21 is a composite of the pressures p and p' as seen in FIG. 4C. In particular, if the total polishing pressure applied to the substrate 11 is represented by P, the area of the bottom face of the truncated cone which is the deformed shape of the polishing cloth 21 is the unit area 1 and the area rate of the top face of the truncated cone with respect to the area of the bottom face is represented by $\alpha$, then $P=(p+p')\alpha+p(1-\alpha)$. Here, if the polishing pressure to the convex portion 12 of the substrate 11 is represented by $P_1$ and the polishing pressure to the concave portion 13 of the substrate 11 is represented by $P_2$, then $p+p'=P_1$ and $p=P_2$, and P can be expressed, as an equation for distribution of the area rate $\alpha_{1i,j}$ to a compression ratio, as the following expression (1):

$$P_1\alpha_{1i,j}+P_2(1-\alpha_{1i,j})=P \tag{1}$$

Then, from the Young's module E of the polishing cloth 21, the thickness U of the polishing cloth 21, the height $X_1-X_2$ between the convex portion and the concave portion of the substrate 11 and the area rate $\alpha_{1i,j}$, the difference $P_1-P_2$ between the polishing pressures on the convex portion 12 and the concave portion 13 of the substrate 11 is determined in accordance with the following expression (2):

$$(P_1-P_2)\alpha_{1i,j}=(\alpha_{1i,j}+\sqrt{\alpha_{1i,j}}+1)(X_1-X_2)[E/3U] \tag{2}$$

As can be recognized from the expression (2) above, the spring constant of the polishing cloth 21 is $(\alpha_{1i,j}+\sqrt{\alpha_{1i,j}}+1)(X_1-X_2)[E/3U\alpha_{1i,j}]$.

Then, in a "polishing amount distribution determination" step S4, the distribution of the polishing amount after a fixed interval of time is determined from the distribution of the polishing pressure. In particular, the distribution of the polishing amount after the fixed interval of time is determined, from a relationship among the polishing pressure P, the relative velocity V and the polishing rate −dX/dt, in accordance with the following expressions (3) and (4):

$$-kVP_1=dX_1/dt \tag{3}$$

$$-kVP_2=dX_2/dt \tag{4}$$

Then, in a "substrate height distribution determination" step S5, the height distribution of the substrate 11 is determined from the distribution of the polishing amount after the fixed interval of time. In particular, the height distribution of the substrate 11 is determined from the height $X_1$ of the convex portion 12 of the substrate 11 and the height $X_2$ of the concave portion 13 of the substrate 11 in accordance with relationships given by the following expressions (5) and (6):

$$X_1=X_0-kVPt+\alpha_{1i,j}h_0+(1-\alpha_{1i,j})h_0\times\exp[-kVtE(\alpha_{1i,j}+\sqrt{\alpha_{1i,j}}+1)/(3U\alpha_{1i,j})] \tag{5}$$

$$X_2=X_0-kVPt+\alpha_{1i,j}h_0-\alpha_{1i,j}h_0\times\exp[-kVtE(\alpha_{1i,j}+\sqrt{\alpha_{1i,j}}+1)/(3U\alpha_{1i,j})] \tag{6}$$

Then, in a "substrate offset determination" step S6, the offset $H_{i,j}$ of the substrate after polishing is determined in accordance with the following expression (7):

$$\begin{aligned} H_{i,j} &= \alpha_{0i,j}X_1+(1-\alpha_{0i,j})X_2 \\ &= X_0-kVPt+ \\ &\quad h_0\left[\alpha_{0i,j}\exp\left\{-kVtE\left(\alpha_{1i,j}+\sqrt{\alpha_{1i,j}}+1\right)/(3U\alpha_{1i,j})\right\}\right]+ \\ &\quad \alpha_{1i,j}\left[1-\exp\left\{-kVtE\left(\alpha_{1i,j}+\sqrt{\alpha_{1i,j}}+1\right)/(3U\alpha_{1i,j})\right\}\right] \end{aligned}$$

In the present polishing simulation, the expression (7) above is given in this manner.

In the polishing simulation, since it is assumed that the polishing cloth is deformed to present a truncated cone, as the area rate of the convex portion of the substrate decreases, the pressure applied to the convex portion increases, which allows an actual polishing phenomenon to be regenerated with a higher degree of fidelity. Also an initial stage of polishing is regenerated with a higher degree of accuracy. Further, when compared with a ordinary polishing simulation, since the expression (7) for determination of an offset of a substrate is given, calculation comes to an end without calculating a transitive solution, and consequently, the speed of calculation can be raised and the time required for calculation can be reduced significantly. Consequently, the number of available data (number of grids) can be increased to raise the accuracy in calculation so that a highly accurate polishing simulation can be performed in a short time.

Consequently, for example, by calculating a convex area density at different points of a chip from mask data and feeding back the convex area density to a height distribution of the chip after polishing, it is possible to detect a point of the chip at which the chip is not likely to be polished satisfactorily prior to production of a mask to optimize the layout of the mask or to estimate an initial film thickness or an optimum polishing time prior to test production of the mask depending upon the shape of the offset.

Figure 5:
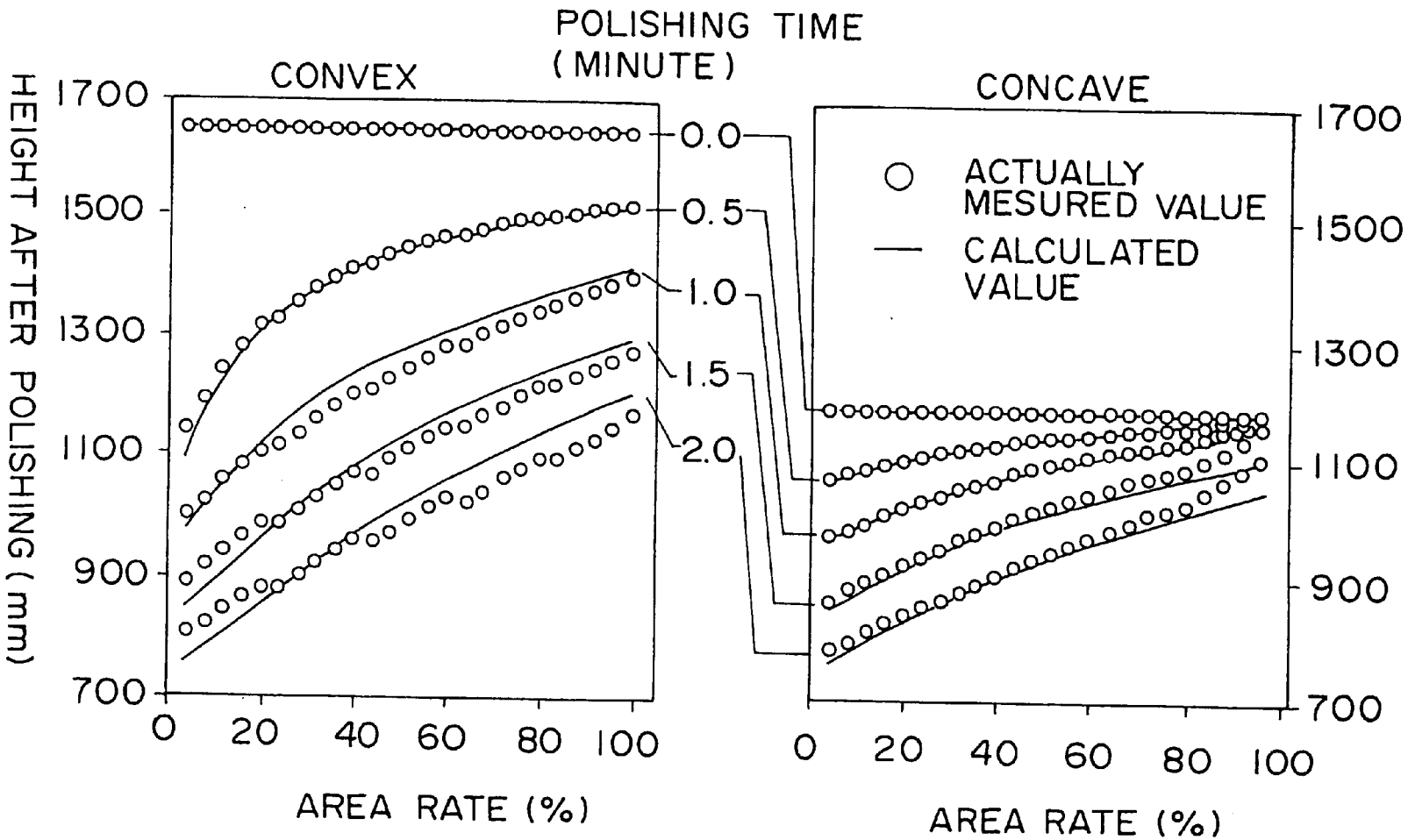
FIG. 5 is a graph illustrating relationships between the height and the area rate of a substrate after polishing by the polishing simulation and actual polishing.

The offset of the substrate determined by the polishing simulation described above and the offset of the substrate determined by actual polishing are compared with each other with reference to FIG. 5. In FIG. 5, the axis (nm) of ordinate indicates the height of the convex portion and the height of the concave portion of the substrate after polishing, and the axis of abscissa indicates the area rate by $\alpha \times 100$ (%). Further, the polishing time (minute) is employed as a parameter.

From FIG. 5, it can be seen that the relationship between the height and the area rate of the substrate after polishing by the simulation indicated by each of solid line curves in FIG. 5 almost regenerates measured values of the height of the substrate determined by the actual polishing indicated by small blank round marks (○). A good regeneration result is obtained particularly where the area rate is low. As the area rate of the convex portion decreases, the pressure applied to the convex portion increases and an actual polishing phenomenon can be regenerated with a higher degree of fidelity. It is to be noted that, in the simulation described above, the value of E/U was set to 113 GPa/m.

Having now fully described the invention, it will be apparent to one of ordinary skill in the art that many changes and modifications can be made thereto without departing the spirit and scope of the invention as set forth herein.

What is claimed is:

1. A method for simulating polishing an uneven surface of a substrate with a polishing cloth in order to level the uneven surface, comprising the steps of:

(a) determining the deformation amount of the polishing cloth imparted by a convex portion of the substrate using a truncated cone as the shape of the deformation of the polishing cloth;

(b) determining the distribution of the polishing pressure of the polishing cloth based on (a) the determination of the deformation amount of the polishing cloth;

(c) determining the distribution of the polishing of the substrate effected by the polishing cloth after a fixed interval of time based on (b) the determination of the distribution of the polishing pressure of the polishing cloth;

(d) determining a distribution of a height of the substrate based on (c) the determination of the distribution of the polishing of the substrate effected by the polishing cloth after a fixed interval of time;

(e) determining the offset of the substrate based on (d) the determination of the distribution of the height of the substrate; and (f) generating an output expressing the offset.

2. The method according to claim 1, wherein, the thickness of a substrate when a polishing time t is t=0 in an initial state of polishing is represented by $X_0$, an offset on the substrate is represented by $h_0$, the Young's module of the polishing cloth is represented by E, the thickness of the polishing cloth is represented by U, the height of the truncated cone is represented by $X_{1-X2}$, the unit area of the bottom face of the truncated cone is represented by 1, and an averaged value of the area rates of the top faces of the truncated cones to the bottom faces of the truncated cones at points (i, j) over a fixed area S is represented by $\alpha_{1i,j}$, the deformation amount of the polishing cloth is represented by $(\alpha_{1i,j}+\sqrt{\alpha_{1i,j}}+1)(X_1-X_2)/3$, and the distribution of the polishing pressure is determined in accordance with an expression (1):

$$P_1\alpha_{1i,j}+P_2(1-\alpha_{1i,j})=P \quad (1)$$

for application for distribution of the area rate $\alpha$1i,j in a pressure ration where $P_1$ is the polishing pressure to the convex portion of the substrate and $P_2$ is the polishing pressure to the concave portion of the substrate and with another expression (2):

$$(P_1-P_2)\alpha_{1i,j}=(\alpha_{1i,j}+\sqrt{\alpha_{1i,j}}+1)(X_1-X_2)[E/3U] \quad (2)$$

for application for determination of the difference $P_1-P_2$ between the polishing pressures on the convex portion and the concave portion of the substrate from the Young's module E of the polishing cloth, the thickness U of the polishing cloth, the height $X_1-X_2$ of the truncated cone and the area rate $\alpha_{1i,j}$, whereafter the distribution of the polishing amount after the fixed interval of time is determined in accordance with following expressions (3) and (4):

$$-kVP_1=dX_1/dt \quad (3)$$

$$-kVP_2=dX_2/dt \quad (4).$$

* * * * *